US007805810B2

(12) United States Patent
Hoffman

(10) Patent No.: US 7,805,810 B2
(45) Date of Patent: Oct. 5, 2010

(54) MULTI LEAF EXTENDABLE GEAR HINGE

(76) Inventor: Lawrence Andrew Hoffman, 201 SE. Oak St., Portland, OR (US) 97314

( * ) Notice: Subject to any disclaimer, the term of this patent is extended or adjusted under 35 U.S.C. 154(b) by 759 days.

(21) Appl. No.: 11/716,114

(22) Filed: Mar. 10, 2007

(65) Prior Publication Data

US 2008/0216288 A1 Sep. 11, 2008

Related U.S. Application Data

(60) Provisional application No. 60/828,224, filed on Oct. 5, 2006.

(51) Int. Cl.
*E05D 7/00* (2006.01)

(52) U.S. Cl. ..... 16/354; 16/366

(58) Field of Classification Search ..... 16/354, 16/366, 368–370, 262, 386, 79, 54, 62, 69, 16/64, 50; 296/146.11, 146.5, 146.9; 248/476, 248/477, 479, 484, 486, 485
See application file for complete search history.

(56) References Cited

U.S. PATENT DOCUMENTS

| | | | | | |
|---|---|---|---|---|---|
| 1,224,036 | A * | 4/1917 | Sutton | 16/366 |
| 1,554,161 | A * | 9/1925 | Hubbard | 16/368 |
| 2,200,142 | A * | 5/1940 | Witschi | 16/369 |
| 2,206,739 | A * | 7/1940 | Brogren et al. | 16/354 |
| 2,326,657 | A * | 8/1943 | Johnston | 396/428 |
| 3,163,883 | A * | 1/1965 | Olsson | 16/354 |
| 5,170,975 | A * | 12/1992 | Chadwick | 248/284.1 |
| 5,566,030 | A * | 10/1996 | Yue | 359/872 |
| 5,867,872 | A * | 2/1999 | Katoh | 16/337 |
| 6,163,929 | A * | 12/2000 | Bradley | 16/380 |
| 6,994,393 | B2 * | 2/2006 | Votruba et al. | 296/100.06 |
| 2008/0083090 | A1 * | 4/2008 | Hoffman | 16/367 |
| 2009/0013500 | A1 * | 1/2009 | Ueyama et al. | 16/354 |

OTHER PUBLICATIONS

U.S. Appl. No. 11/868,467, filed Oct. 5, 2007, Hoffman, Lawrence, File Wrapper.

* cited by examiner

*Primary Examiner*—Chuck Y. Mah
(74) *Attorney, Agent, or Firm*—Mark S. Hubert

(57) ABSTRACT

The present invention is an extremely compact three leaf geared hinge that is adapted to handle heavy loads, tightly fold back onto itself for space conservation, offer extensive freedom of movement in the horizontal plane and provide an extremely smooth operating action with minimal play in torsion as well as in axial or transverse motions. The hinge has three interconnected leaves jointed by hinge pins. The inner and outer leaves each have two fixed gears on their sides that meshingly engage a set of two rotating gears located on the sides of the middle leaf. The inner leaf has a cylindrical leaf and pin arrangement on one end that may be rotatably secured to a rigid member or housing. The free end of the outer leaf may be attached to the load directly or with a device that allows the load to rotate normally about the extended hinge.

11 Claims, 10 Drawing Sheets

MULTI LEAF EXTENDABLE GEAR HINGE

Applicant claims priority from provisional application 60/828,224 filed Oct. 5, 2006 and incorporates herein by reference all of said provisional patent application.

BACKGROUND OF THE INVENTION

The present invention relates to a extremely compact three leaf geared hinge that is adapted to handle heavy loads, tightly fold back onto itself for space conservation, offer extensive freedom of pivotal movement in the horizontal plane and provide an extremely smooth operating action with minimal lateral or transverse play.

Precision movement and location of heavy objects is desirable in numerous situations. An example of this is the biaxial movement of a car door through a non conventional path of travel as would be found on an exotic sports car or a customized hot rod. Here, precision of movement while supporting a heavy load is necessary to both enable the smooth opening of the car door and to protect vehicle surfaces from contacting each other unwantedly. Conventional, existing art hinge design is based on one or two pivot axes, and utilize cylindrical knuckles thereby preventing complete compaction. Further, they require a considerable amount of space in which to be housed because of the extensive amount of travel an car door must undergo when opening to clear the fender for upward rotation.

The present invention hinge utilizes a multiple, linearly extendable, leaf configuration that allows limited pivotable movement in the horizontal (XY) plane. It can be compactly retracted by the abutment of all leaves together through the use of a beveled rabbet on the ends of the hinge leaves and the elimination of cylindrical knuckles. This abutment is accomplished by the unique leaf design at the knuckle interface ends of each leaf. The adjacent leaves have pairs of enmeshed alternating fixed and rotating gears located on their sides to eliminate play in the hinge and to offer extremely smooth operation.

A further advantage of having a multi leaf extensible hinge is that movement restriction of any single hinge can shape the opening profile of the entire hinge. This allows the hinge of the present invention to accommodate the torturous path of travel encountered by car door that opens in more than one plane.

Henceforth, a smooth acting, strong, extremely compact, zero play hinge would fulfill a long felt need in many industries where heavy loads must be held and precisely moved. This new invention utilizes and combines known and new technologies in a unique and novel configuration to overcome the aforementioned problems and accomplish this.

SUMMARY OF THE INVENTION

The general purpose of the present invention, which will be described subsequently in greater detail, is to provide a compact hinge that is able to enable movement of heavy loads, offer extensive freedom of pivotal movement in the horizontal plane and provide an extremely smooth operating action with minimal torsional, lateral or transverse play.

It has many of the advantages mentioned heretofore and many novel features that result in a new hinge which is not anticipated, rendered obvious, suggested, or even implied by any of the prior art, either alone or in any combination thereof.

In accordance with the invention, an object of the present invention is to provide an improved hinge capable of minimal torsional, lateral or transverse unwanted motion or play so as to enable the critical positioning of loads.

It is another object of the present invention to provide an improved hinge capable of superior smoothness of operation.

It is a further object of this invention to provide a hinge that offers extensive freedom of pivotal movement in the horizontal plane to accommodate convoluted paths of load travel.

It is still a further object of this invention to provide for a multi leaf hinge capable of linear extension and pivotable movement in the horizontal plane.

It is yet a further object of this invention to provide a multi leaf hinge capable of the maximum compact retraction.

The subject matter of the present invention is particularly pointed out and distinctly claimed in the concluding portion of this specification. However, both the organization and method of operation, together with further advantages and objects thereof, may best be understood by reference to the following description taken in connection with accompanying drawings wherein like reference characters refer to like elements. Other objects, features and aspects of the present invention are discussed in greater detail below.

DETAILED DESCRIPTION

Figure 1:
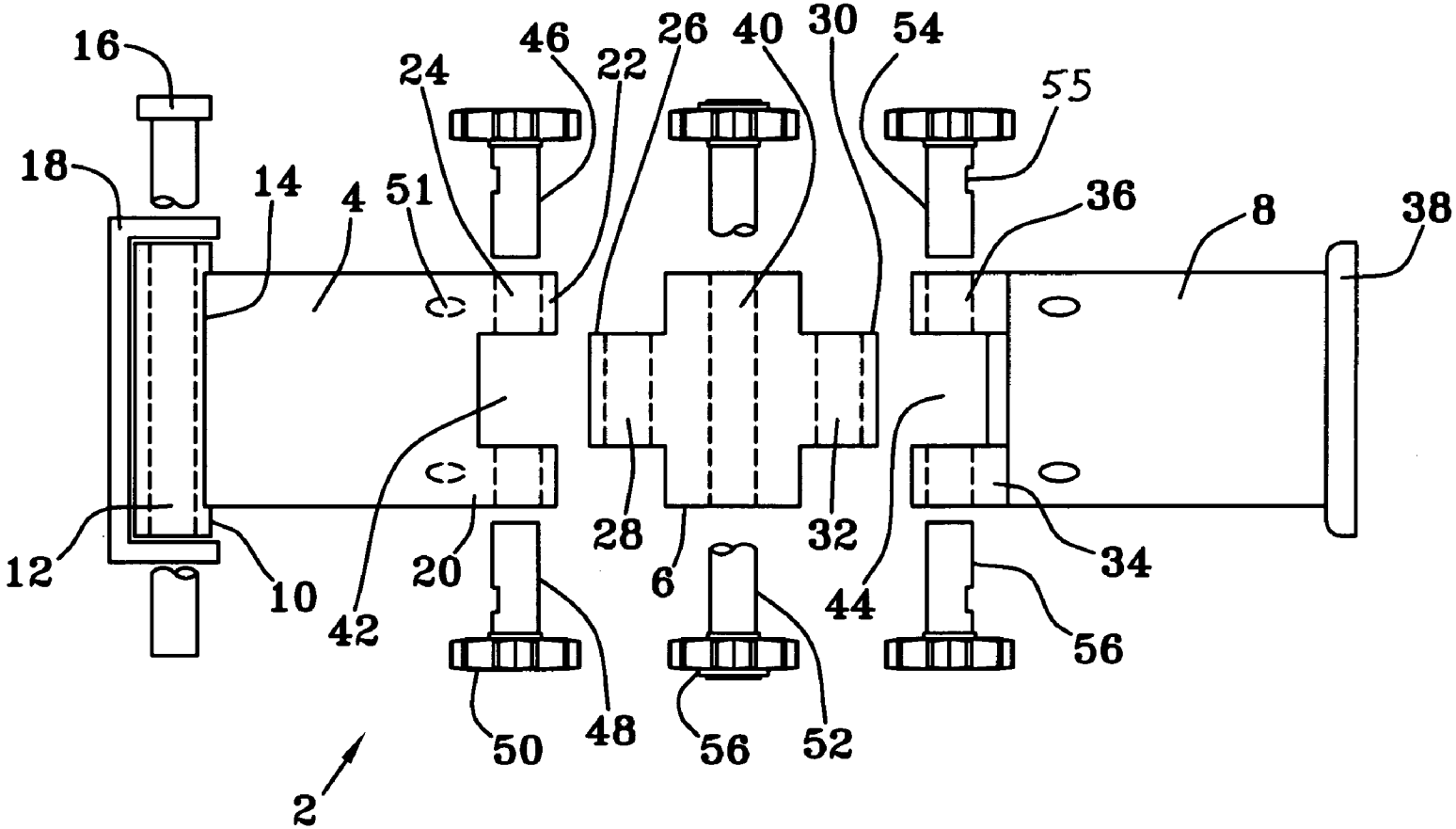
FIG. 1 is an exploded assembly side view of the multi leaf extendable gear hinge showing all the components.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

The above description will enable any person skilled in the art to make and use this invention. It also sets forth the best modes for carrying out this invention. There are numerous variations and modifications thereof that will also remain readily apparent to others skilled in the art, now that the general principles of the present invention have been disclosed.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

In the following detailed description, various terms are used to define various elements of the present hinge. Other terms are used in the art to reference the same hinge element. Therefore, it is understood that the present invention is not to be limited by the use of a particular term used in reference to a particular hinge element. The terminology utilized in this specification for the most follows the terminology of a conventional hinge, although the present invention functions quite differently. These differences are best explained at this point.

A conventional hinge comprises two leaves, namely a stationary leaf and a hinge leaf, which pivot on a single axis of rotation; a leaf consists generally of a mounting portion, such as, but not limited to, a mounting plate, and one or more knuckles; a knuckle comprises an element, generally circular, having a bore adapted to accept a hinge pin, the knuckle extending from a mounting portion of a leaf; a notch is a space between two adjacent knuckles on one leaf into which a knuckle from a second leaf is positioned and interleaved; a stationary leaf is the leaf which is attached to a non-moving structure, such as a door frame; a hinge leaf is a leaf which is attached to a door; and a hinge pin is generally a rod adapted to pass through the bore of the interleaved knuckles of two leaves to join the leaves together.

The differences between the components in a convention hinge and the multi leaf extendable gear hinge, as well as the terminology can best be understood with the following explanation of terminology. The present multi leaf hinge comprises multiple leaves, namely an inner, middle and outer leaf. All leaves are hinge leaves which pivot on different axes of rotation but all in the same horizontal plane; there are no stationary leaves but there is a stationary mounting assembly; a leaf consists generally of a planar element with at least one knuckle thereon; a knuckle comprises the end of a leaf that has a beveled rabbet formed thereon with a bore therethrough adapted to accept a hinge pin, or the cylindrical end of a leaf with a bore therethrough adapted to accept a hinge pin; a notch is a space between two adjacent knuckles on one leaf into which a knuckle from another leaf is positioned and interleaved; a hinge pin is a set of non rotating short stub shafts adapted to pass through all or some of the bore of the interleaved knuckles of two leaves to join the leaves together; a fixed gear is a gear fixed on the end of the non rotating stub shafts (which are also the axis of pivot for the leaf); a rotatable shaft is a rod passing through an orifice in the middle leaf; a pivot gear is gear mounted on the end of a rotatable shaft.

Figure 2:
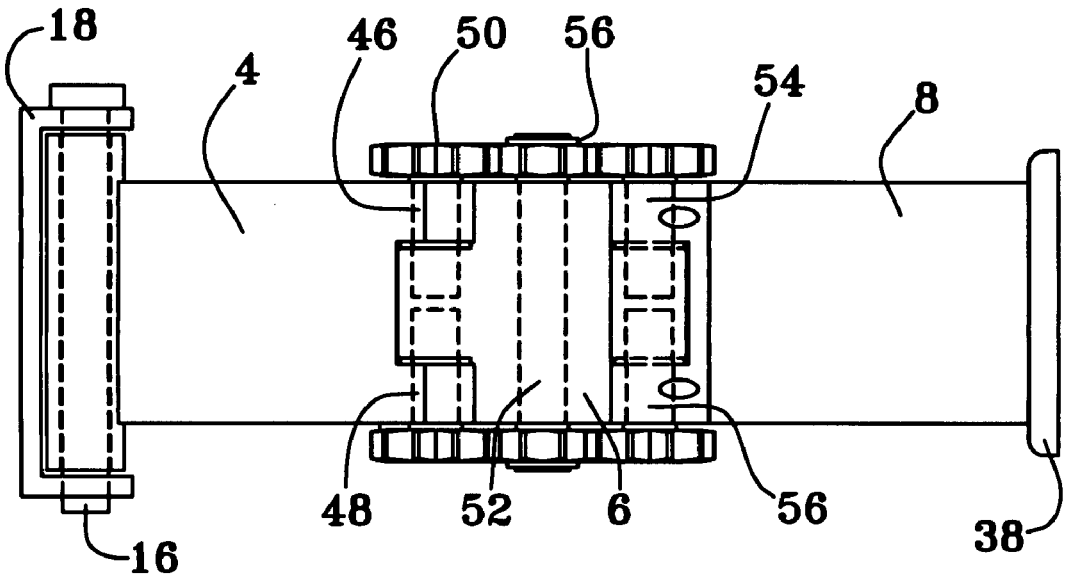
FIG. 2 is a assembly side view of the multi leaf extendable gear hinge showing all the components.

Looking at FIGS. 1 and 2 the construction of the preferred embodiment of the present invention can best be understood. The multi leaf extendable gear hinge 2 has an inner leaf 4, a middle leaf 6 and an outer leaf 8. The inner leaf 4 has a cylindrical-knuckle 10 with a first vertical bore 12 therethrough at the inner leaf's distal end 14. A mounting pin 16 passes through a top orifice in mounting assembly 18, the mounting assembly bore 12 and a bottom orifice. The proximate end 20 of the inner leaf 4 has first knuckle 22 formed thereon with first vertical bore 24 therethrough. The middle leaf 6 has second knuckle 26 formed at it's distal end with second vertical bore 28 formed therethrough, and third knuckle 30 formed at it's proximate end with third vertical bore 32 formed therethrough. The middle leaf 6 also has vertical pivot bore 40 formed therethrough, parallel to the second vertical bore 28 and third vertical bore 32. The outer leaf 6 has a fourth knuckle 34 formed at it's distal end with fourth vertical bore 36 formed therethrough and mounting plate 38 affixed to it's proximate end. The vertical axes of pivot bore 40, second vertical bore 28 and third vertical bore 32 are not horizontally aligned.

First knuckle 22 has a first space 42 into which second knuckle 28 is interleaved such that first vertical bore 24 aligns with second vertical bore 28 when first stub shaft 46 and second stub shaft 48 are inserted therein. Allen screws threadingly engaged through threaded bores 51 bear on flats 55 on first stub shaft 46 and second stub shaft 48 prevent the rotation of the stub shafts within the interleaved bores. In a similar fashion, fourth knuckle 34 has a second space 44 into which third knuckle 34 is interleaved such that fourth vertical bore 36 aligns with third vertical bore 32 when third stub shaft 54 and fourth stub shaft 56 are inserted therein. Allen screws threadingly engaged through threaded bores 51 bear on flats 55 on third stub shaft 54 and fourth stub shaft 56 prevent the rotation of the stub shafts within the interleaved bores.

Pivot pin 52 resides in pivot bore 40. Bevel gear 50 is permanently affixed to the exposed ends of the first, second, third and fourth stub shafts and rotationally connected at both ends of pivot pin 52. Circlips 56 about a recess in the ends of the pivot pin retain the bevel gear on the pivot pin 52 and accommodate pivot pin 52 installation as is well known in the art.

Figure 3:
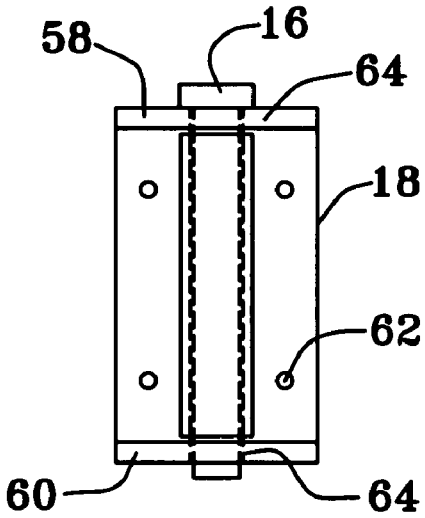
FIG. 3 is a front view of the mounting assembly.

Looking at FIG. 3, it can be seen that the mounting assembly 18 is a planar plate with a top flange 58 and bottom flange 60 extending normally therefrom. Multiple mounting orifices 62 are formed through the planar plate to accommodate mechanical fasteners to attach the mounting assembly to a suitable brace member. The top flange 58 and bottom flange 60 have apertures 64 that are dimensioned to accept mounting pin 16. When apertures 64 are aligned with mounting assembly bore 12, mounting pin 16 may be inserted therethrough so as to secure the multi leaf extendable gear hinge to the brace member. The inner leaf 4 is free to pivot about the longitudinal axis of mounting pin 16.

Figure 4:
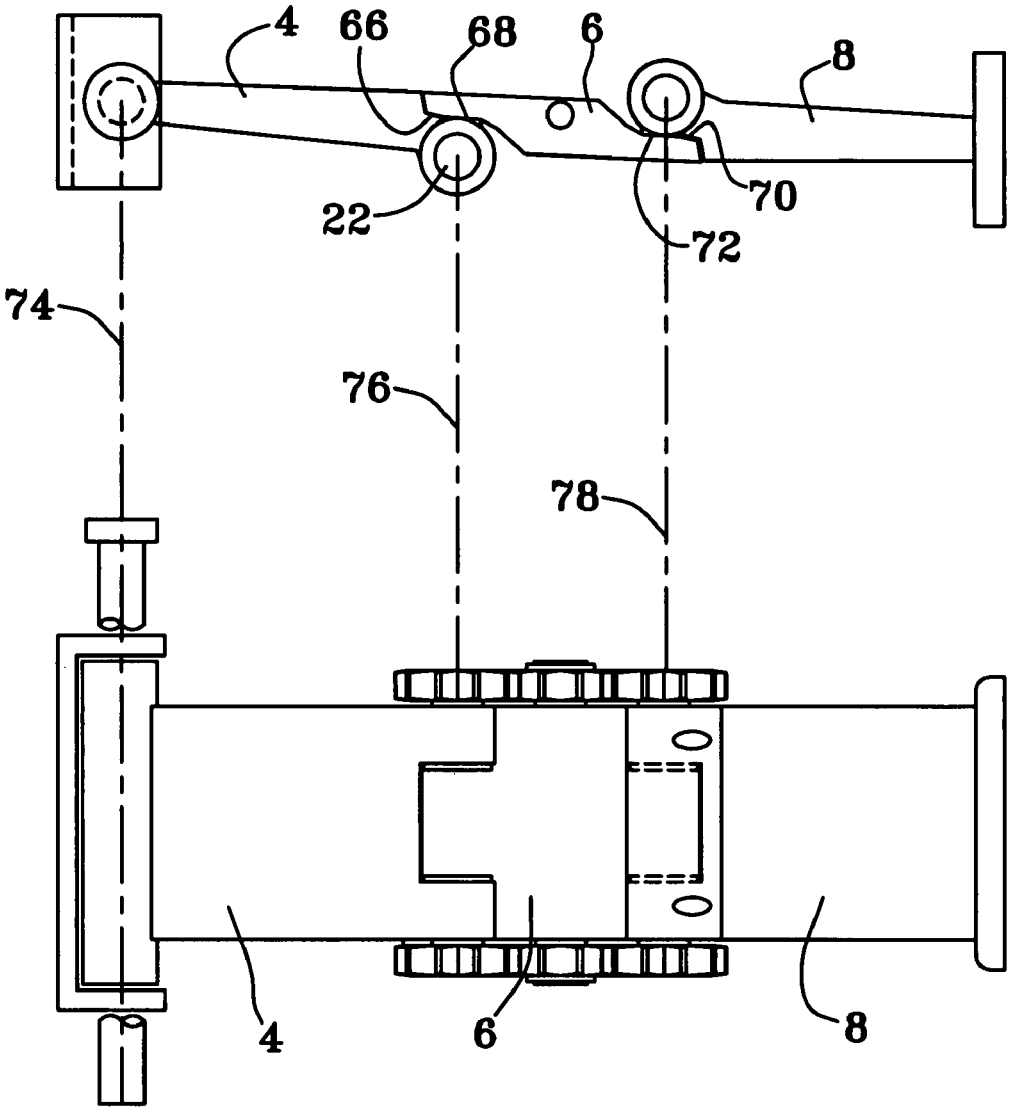
FIG. 4 is a perspective top and side view of the multi leaf extendable gear hinge showing the pivotable axes.

Looking at FIG. 4 the top view of the multi leaf extendable gear hinge, the configuration of the inner leaf 4, middle leaf 6 and outer leaf 8 can best be seen. At the proximate end of inner leaf 4 adjacent first knuckle 22, is first beveled rabbet 66 matingly conformed to second rabbet 68 on the distal end of middle leaf 6. Similarly, outer leaf 8 has fourth beveled rabbet 70 adjacent second knuckle 28 at the distal end that is matingly conformed to third beveled rabbet 72 formed on the proximate end of middle leaf 6. The three axes of pivot for the multi leaf extendable gear hinge are shown as first pivot axis 74 second pivot axis 76 and third pivot axis 78.

Figure 5A:
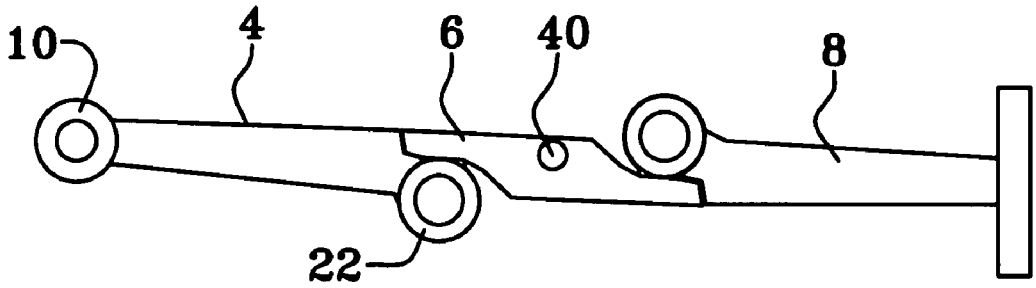
FIGS. 5*a*, 5*b*, and 5*c* are top views of the extendable movement capability of the of the multi leaf extendable gear hinge with the gears removed.
Figure 5B:
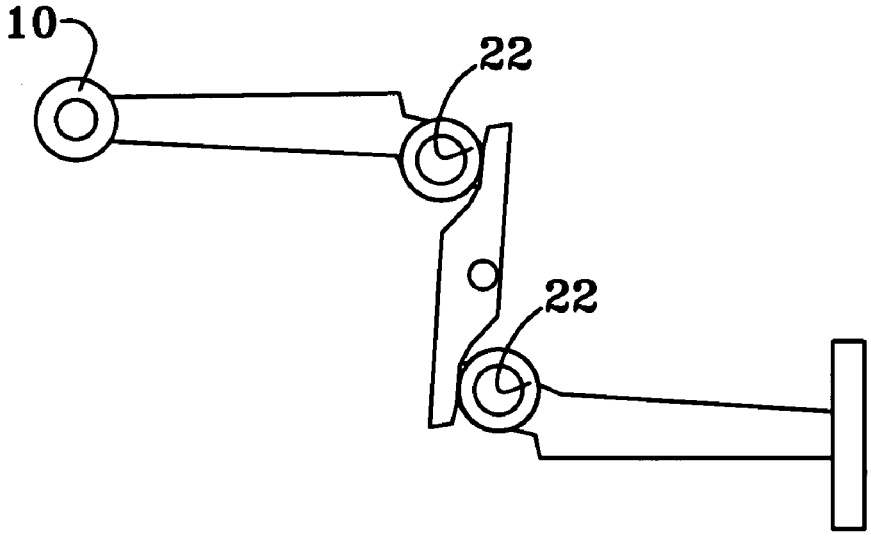
Figure 5C:
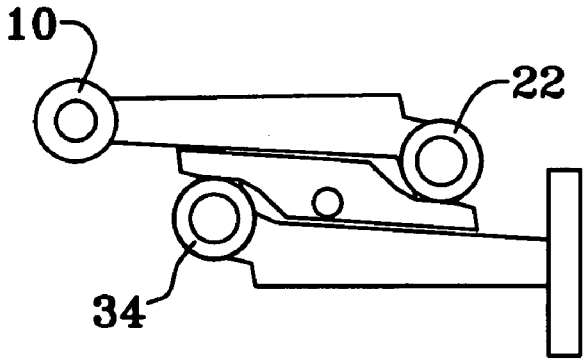

FIGS. 5*a*, 5*b* and 5*c* show top views of the multi leaf extendable gear hinge in the fully open, intermediate and fully retracted positions. (The gears have been removed for visual clarity.) In the fully extended position depicted in FIG. 5*a*, the multi leaf extendable gear hinge remains free for limited movement about the horizontal plane, pivoting about cylindrical knuckle 10. In this position there is complete abutment between all beveled rabbets. In the intermediate position depicted in FIG. 5*b*, it can be seen that middle leaf 6 is capable of pivoting 180 degrees about the interleaved first knuckle 22 and second knuckle 26, and outer leaf 8 is capable of pivoting 180 degrees about the interleaved third knuckle 30 and fourth knuckle 34, while the entire multi leaf extendable gear hinge is free to pivot about cylindrical knuckle 10. In the retracted position depicted in FIG. 5*c* the compactability of the multi leaf extendable gear hinge can be seen. Because of the beveled rabbet configuration on the leaves, one side of the middle leaf 6 is capable of complete abutment with one side of the inner leaf 3 while the opposite side of the middle leaf 6 is capable of complete abutment with one side of the outer leaf 8. In this manner the maximum amount of compactness can be achieved while allowing a load affixed to the proximate end of third leaf 8 to experience a plethora of movement paths. This design is especially well adapted in the situation, such as the opening of a car door where more than one axis of door movement is desired.

Figure 6A:
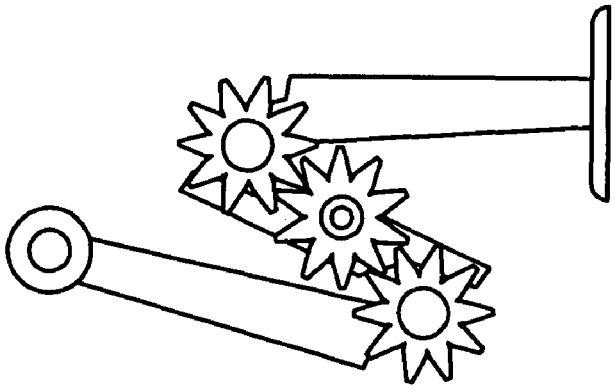
FIGS. 6*a*, 6*b* and 6*c* are bottom views of the multi leaf extendable gear hinge.
Figure 6B:
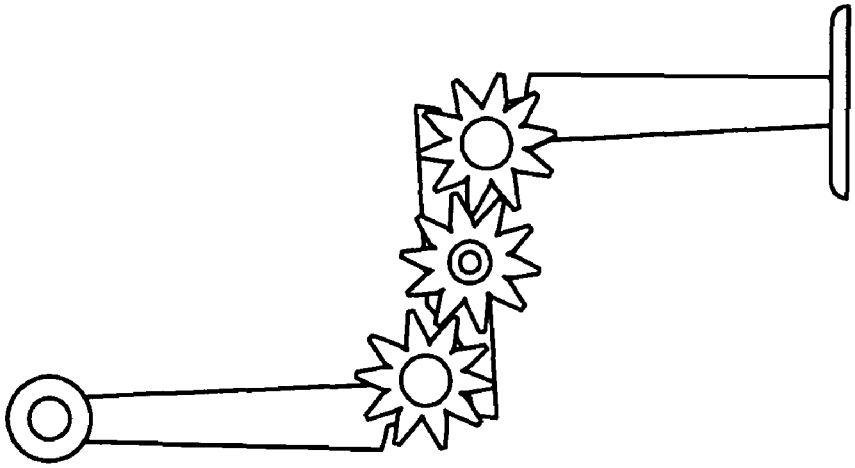
Figure 6C:
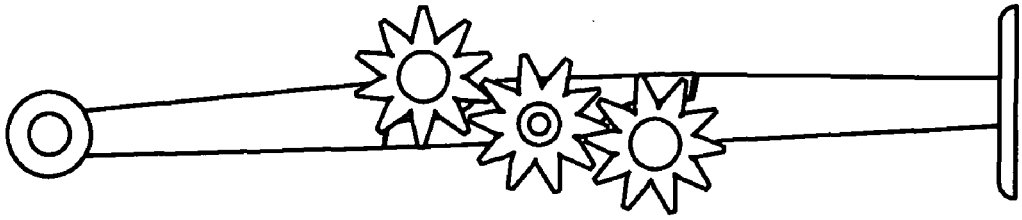

FIGS. 6*a*, 6*b* and 6*c* show bottom views of the multi leaf extendable gear hinge with the bevel gears 50 installed. The spur gears 50 on pivot pin 52 do not act as an idler gears since they do not transmit motion from the bevel gears 50 on the first and third stub shafts to the bevel gears 50 on the second and fourth stub shafts. The bevel gears on pivot pin 52 rotate when the inner leaf 4, middle leaf 6 or outer leaf 8 are moved relative to each other. Because of the beveled gear's tooth design and close tolerance enmeshment, they maintain a degree of horizontal tension between the inner, middle and outer leaves. This coupled with the use of pairs of beveled gears 50 on each leaf, eliminates unwanted torsional play in the hinge and results in an extremely smooth acting hinge. These are desirable features in a hinge for moving heavy loads that require zero tolerance positioning. All spur gears are of the same diameter, have the same number of teeth and teeth forms with substantially similar pressure angles. Different gear combinations and spacing may be utilized as is known in the field of art.

Figure 7:
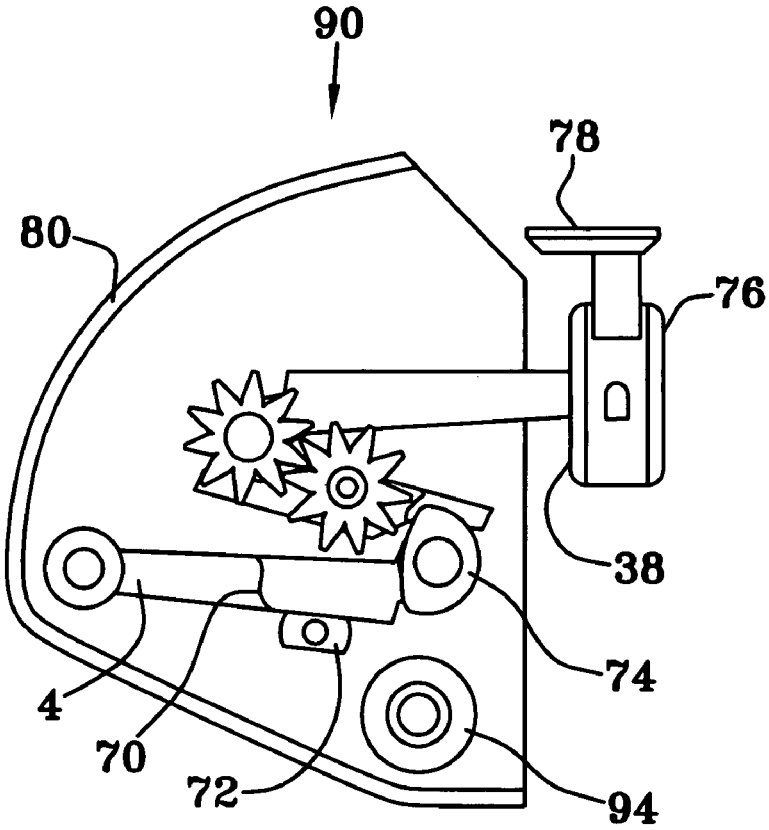
FIG. 7 is a top view of the alternate embodiment multi leaf extendable gear hinge with the housing top plate removed.
Figure 12:
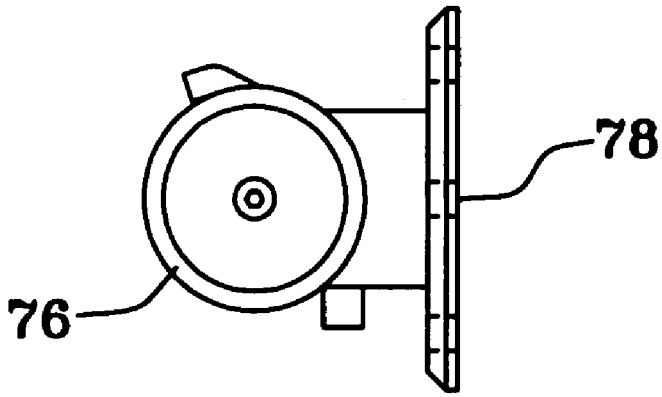
FIG. 12 is a side view of a rotational means capable of mounting on the load mounting plate.

FIG. 7 shows a top view of the alternate embodiment multi leaf extendable gear hinge 90 with the housing top plate removed. This alternate embodiment illustrates a practical example of the use of the multi leaf extendable gear hinge. In this drawing, first leaf 4 has been partially removed at cut line 70 so as to eliminate it's bevel gear and first knuckle 22 from illustration. In this way, movement constriction pin 72 and movement direction cam 74 can best be seen in relation to the overall embodiment. A rotational member 76 has been attached to the mounting plate 38 so as to enable vertical rotational movement of any load (such as a car door) affixed to mounting bracket 78. Reference FIG. 12.) Such members are well known in the art. Hinge housing 80 replaces mounting assembly 18. Hinge housing 80 is a concave enclosure that houses the alternate embodiment multi leaf extendable gear hinge and is suitable for attachment to a vehicle by such methods as welding or mechanical fastening. Mounting pin 16 is replaced with first bolt 82 that secures the cylindrical knuckle 10 in the housing 80, passing through an orifice in the housing top plate 84, the first vertical bore 12 and an orifice in the bottom plate (not shown). Cam bearing shaft 94 is a cylindrical rod with a horizontal bore therethrough and with a circular disk 100 affixed thereon, adapted to engage the movement direction cam 74. Cam bearing shaft 94 is held in the desired position for the direction of movement of the middle leaf 6 by second bolt 96 which passes through and orifice in the housing top plate 84 and bottom plate.

Figure 8:
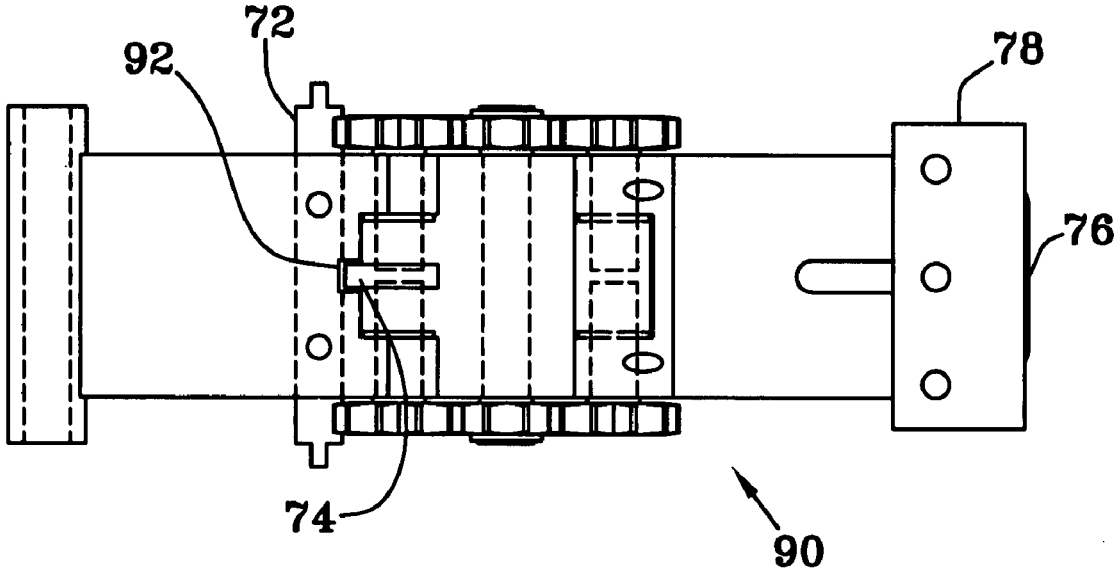
FIG. 8 is a assembly side view of the alternate embodiment multi leaf extendable gear hinge removed from the housing.
Figure 11:
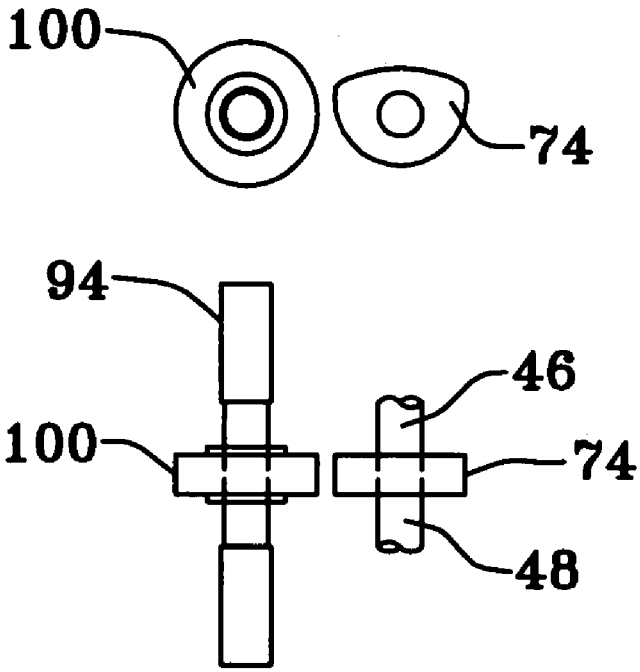
FIG. 11 is a top view of the cam and cam guide atop a side view of the cam and cam guide.

FIG. 8 illustrates an assembled view of the alternate embodiment hinge 90 removed from the hinge housing 80. It contains all of the same components of the preferred embodiment except for the mounting pin 16 and mounting assembly 18 which have been replaced with first bolt 82 and hinge housing 80. The additional elements are: the movement constriction pin 72 which is mechanically affixed to the inner leaf 4, residing normal to the pivot axis of the hinge; movement direction cam 74 which is keyed onto and extends normally from first stub shaft 46 and second stub shaft 48; cam bearing shaft 94; first bolt 82; and second bolt 96. (Reference FIG. 11.) The keyed aspect of the movement direction cam 74 to the first and second stub shafts is not visible in the drawings but such method of attachment is well known in the art. A clearance recess 92 has been cut in first notch 42 to allow the passing of the movement direction cam as the hinge operates. The alternate embodiment hinge 90 operates in principal, identical to that of the preferred embodiment except that it's leaf movement is constrained by the abutment of movement constriction pin 72 against the ends of elongated slots 98 in the housing top and bottom plates. (Illustrated in FIGS. 9*a*, 9*b* and 9*c*.

Figure 9A:
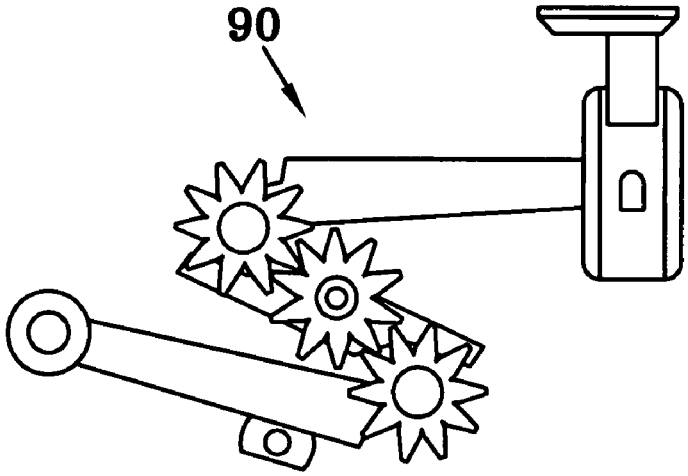
FIGS. 9*a*, 9*b* and 9*c* are top views of the alternate embodiment multi leaf extendable gear hinge without the housing to illustrate the movement of the constrainment pin.
Figure 9B:
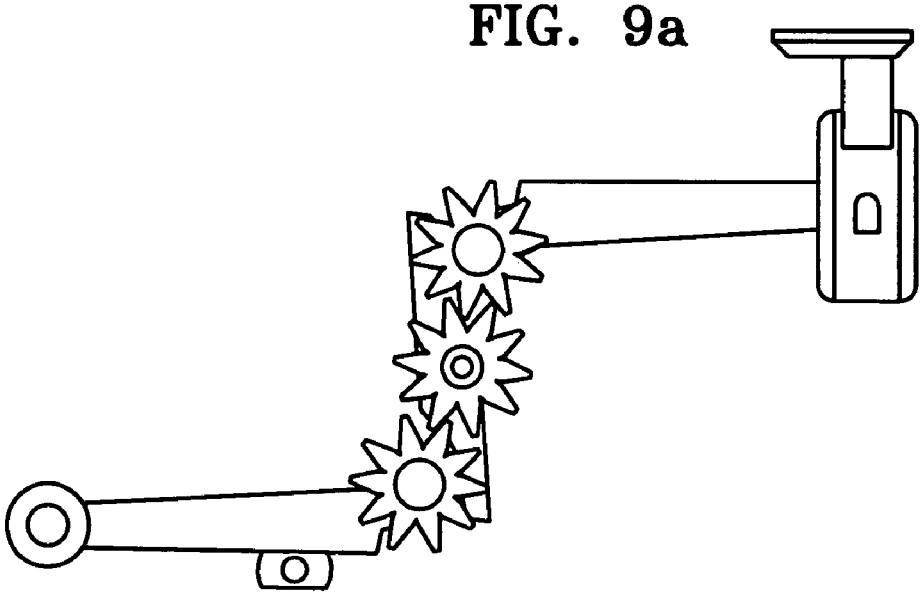
Figure 9C:
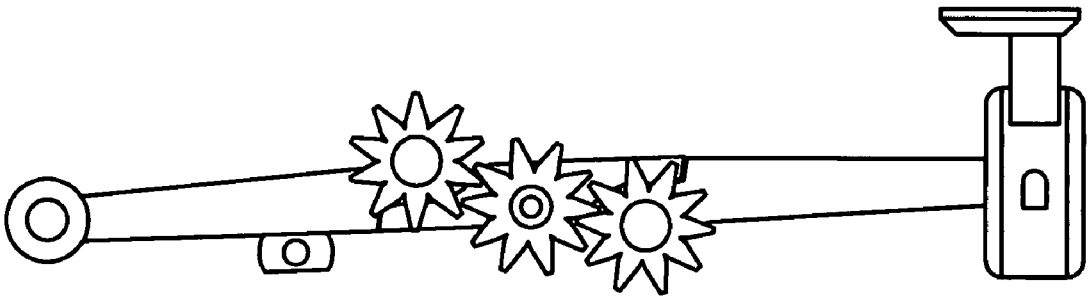

FIGS. 9*a*, 9*b* and 9*c* show the operation of the alternate embodiment without the hinge housing 80. By way of comparison with FIGS. 6*a*, 6*b* and 6*c* it can be seen that the alternate embodiment hinge 90 has the identical operational motion as the preferred embodiment hinge 2 until the alternate embodiment hinge 90 is affixed inside the housing 80.

Figure 10A:
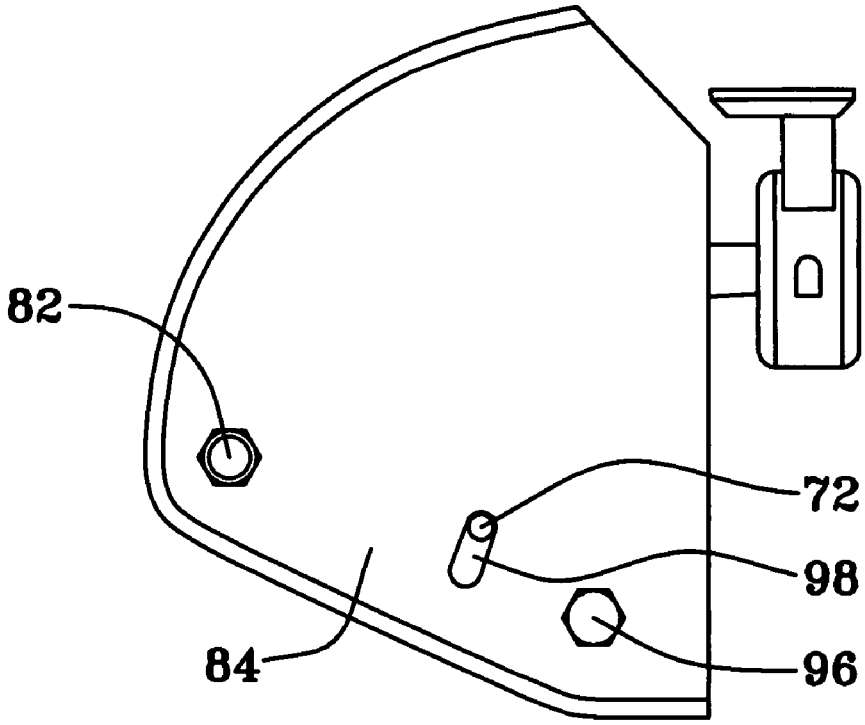
FIGS. 10*a*, 10*b* and 10*c* are top views of the alternate embodiment multi leaf extendable gear hinge with the housing top plate installed illustrating constrained directional movement.
Figure 10B:
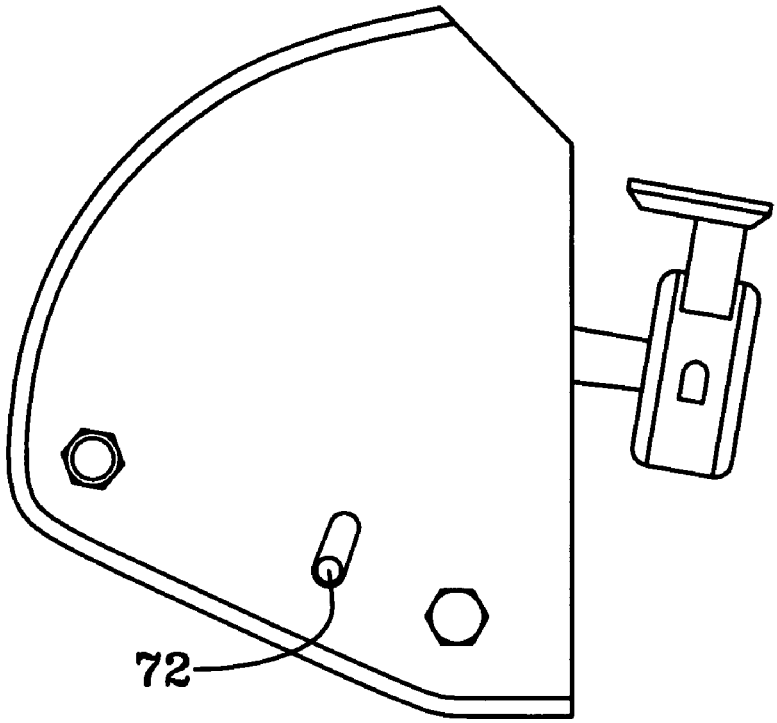
Figure 10C:
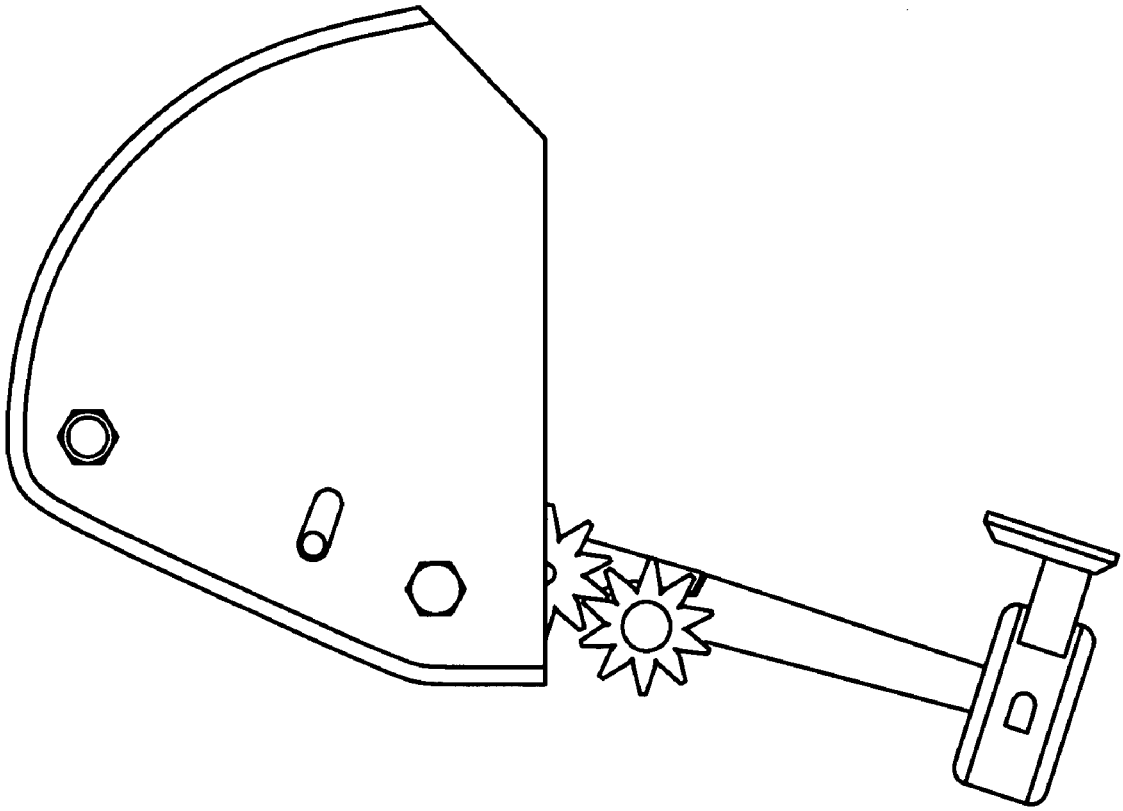

When installed in the housing 80, the load directional movement is dictated by the specific movement direction cam 74 design and placement as well as the specific location of the constriction pin 72 and the configuration of it's associated elongated slot 98. In FIG. 10*a* the hinge is in a position to allow a car door attached to mounting bracket 78 to swing horizontally outward enough to clear the front fender, when horizontal opening force is applied to the door. As this is accomplished, movement constriction pin 72 follows the path of elongated slot 98 coming to rest at the slot's end. At approximately this point the movement direction cam 74 will contact the circular disk 100. (FIG. 10*b*) The continued horizontal opening force will cause the alternate embodiment hinge 90 to extent beyond the housing 80 in a curved path defined by the rotation of the movement direction cam 74 against circular disk 100 of cam bearing shaft 94. This is configured to allow the entire opening door to traverse horizontally away from the car such that when the full extension of the alternate embodiment hinge 90 is reached, the inner side of the car door will clear the car's outer front fender. (FIG. 10*c*) At this point the car door is capable of vertical movement without fear of contacting the car's front fender.

In the situation described above the alternate embodiment hinge 90 will allow a car door to be opened as described herein, traversing the path as outlined below when the appropriate external force is applied.

When the door is first unlatched, the door will pivot open horizontally (at an acute increasing angle from the longitudinal axis of the car) as the fully closed hinge (abutted inner leaf 4, middle leaf 6, and outer leaf 8) pivots about cylindrical knuckle 10. At the same time the movement constraining pin 72 slides back in elongated slot 98. (FIG. 10 *a* to 10*b*) All three leaves of the hinge then begin to fully extend. As the outer leaf 8 and the middle leaf 6 increasingly separate, the movement direction cam 74 contacts cam bearing shaft 94 such that the cam design pushes the inner leaf 4 and the attached constriction pin 72 back along the associated elongated slot 98 to it's initial position. This action forces the front (hinged end) of the car door away from the vehicle a distance greater than the door thickness while moving the door slightly backwards and parallel to the longitudinal axis of the car. As the hinge 90 continues to extend to it's full extent the door is now pulled slightly forward while remaining parallel to the car until the hinge is fully extended. (FIG. 10*c*) At this time the car door and all hinge components have a sufficient spacial clearance from the car's body panels to allow the rotation of the car door about a rotational member 76 attached to the mounting plate 38 so as to enable vertical rotational movement of the car door which is affixed to mounting bracket 78.

Thus the method of opening a car door with the alternate embodiment hinge 90 and rotational member attached to the door, when a constant horizontal force is applied to the car door is as follows:

pivot the car door out at an increasing acute angle from the longitudinal axis of the car; then horizontally move the hinged end of the car door away from the car a distance greater than the thickness of the door while sliding the door rearward and parallel to the longitudinal axis of the car; moving the door forward and parallel to the longitudinal axis of the car; then rotating the car door vertically.

The applications of the present invention are countless as the dynamics of the path of operation can be configured for whatever situation is at hand. Motion in the X axis, Y axis or as a vector motion of the X and Y axes may be accomplished. Essentially, any pre-configured path of motion may be achieved in the horizontal (XY plane) with the present invention.

The abovementioned invention may be mounted into various positions and/or in different orientations on a vehicle so as to allow the door to open as a "suicide door" (wherein the front end of the door swings open, the rear of the door pivots and the door pivots toward the back), as a "reverse suicide door" (wherein the front end of the door swings open, the rear of the door pivots and the door pivots toward the front) or any of a plethora of other opening methods. The hinge is designed so as to allow such installations.

The above description will enable any person skilled in the art to make and use this invention. It also sets forth the best modes for carrying out this invention. There are numerous variations and modifications thereof that will also remain readily apparent to others skilled in the art, now that the general principles of the present invention have been disclosed. As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Having thus described the invention, what is claimed as new and desired to be secured by Letters Patent is as follows:

1. A multi leaf extendable gear hinge comprising:

an inner leaf;

a middle leaf;

an outer leaf;

a mounting assembly; and a load mounting plate; wherein said inner leaf has a vertical cylinder with a vertical bore therethrough, located thereon at a distal end and a segmented first knuckle located thereon with first vertical bore therethrough, located at a proximate end thereof;

said middle leaf has a second cylindrical knuckle with a second vertical bore therethrough, located thereon at a distal end and a third cylindrical knuckle with a third vertical bore therethrough, located thereon at a proximate end and a bore therethrough said middle leaf;

said outer leaf has a segmented fourth cylindrical knuckle with a fourth vertical bore therethrough, located thereon at a distal end and said load mounting plate affixed to a proximate end thereof;

wherein said vertical cylinder is pivotally mounted within said mounting assembly by a pin; and wherein said first knuckle and said second knuckle are held in an interleaved configuration by a fixed first upper stub shaft and a fixed first lower stub shaft and said third knuckle and said fourth knuckle are held in an interleaved configuration by a fixed second upper stub shaft and a fixed second lower stub shaft; and further comprising six substantially similar bevel gears wherein a first bevel gear is affixed to said first upper stub shaft, a second bevel gear is affixed to said first lower stub shaft, a third bevel gear is affixed to a first end of said pivot shaft, a fourth bevel gear is affixed to a second end of said pivot shaft, a fifth bevel gear is affixed to said second upper stub shaft, and a sixth bevel gear is affixed to said second lower stub shaft.

2. The multi leaf extendable gear hinge of claim 1 wherein said first bevel gear, said third bevel gear and said fifth bevel gear are meshingly engaged and said second bevel gear, said fourth bevel gear and said sixth bevel gear are meshingly engaged such that said third bevel gear and said fourth bevel gear rotate with said pivot shaft as said multi leaf extendable gear hinge is opened and closed.

3. The multi leaf extendable gear hinge for claim 1 wherein said inner leaf has a first beveled rabbet on said proximate end, said outer leaf has a second beveled rabbet on said distal end, and said middle leaf has a third beveled rabbet on said distal end and a fourth beveled rabbet on said proximate end wherein said first beveled rabbet is matingly conformed to said third beveled rabbet and said second rabbet is matingly conformed to said fourth beveled rabbet.

4. The multi leaf extendable gear hinge of claim 3 wherein said middle leaf has four threaded horizontal orifices formed therein to threadingly engage set screws that frictionally engage said first upper stub shaft, said first lower stub shaft, said second upper stub shaft and said second lower stub shaft so as to prevent rotational movement of said stub shafts.

5. A multi leaf extendable gear hinge comprising:

an inner leaf;

a middle leaf;

an outer leaf;

a hinge housing having a concave side with a generally planar top plate and a generally planar bottom plate; and a load mounting plate wherein said inner leaf has a vertical cylinder with a vertical bore therethrough, located thereon at a distal end, and a segmented first knuckle with first vertical bore 24 therethrough, located at a proximate end thereof, and a vertical pin mounted thereon a side of said inner leaf extending through a first elongated slot in said top plate and through a second elongated slot in said bottom plate;

said middle leaf has a second cylindrical knuckle with a second vertical bore therethrough, located thereon at a distal end and a third cylindrical knuckle with a third vertical bore therethrough, located thereon at a proximate end and a bore therethrough said middle leaf;

said outer leaf has a segmented fourth cylindrical knuckle with a fourth vertical bore therethrough, located thereon at a distal end and said load mounting plate affixed to a proximate end thereof;

wherein said vertical cylinder is pivotally mounted within said hinge housing by a first bolt passing through said vertical bore in said vertical cylinder and a first orifice formed in said top plate and a second orifice in said bottom plate; and wherein said first knuckle and said second knuckle are held in an interleaved configuration by a fixed first upper stub shaft and a fixed first lower stub shaft and said third knuckle and said fourth knuckle are held in an interleaved configuration by a fixed second upper stub shaft and a fixed second lower stub shaft; and wherein said middle leaf further comprises:

a pivotable shaft residing in a fifth vertical bore therethrough said middle leaf.

6. The multi leaf extendable gear hinge of claim 5 further comprising six substantially similar bevel gears wherein a first bevel gear is affixed to said first upper stub shaft, a second bevel gear is affixed to said first lower stub shaft, a third bevel gear is affixed to a first end of said pivot shaft, a fourth bevel gear is affixed to a second end of said pivot shaft, a fifth bevel gear is affixed to said second upper stub shaft, and a sixth bevel gear is affixed to said second lower stub shaft.

7. The multi leaf extendable gear hinge of claim 6 wherein said first bevel gear, said third bevel gear and said fifth bevel gear are meshingly engaged and said second bevel gear, said fourth bevel gear and said sixth bevel gear are meshingly engaged such that said third bevel gear and said fourth bevel gear rotate with said pivot shaft as said multi leaf extendable gear hinge is opened and closed.

8. The multi leaf extendable gear hinge for claim 7 wherein said inner leaf has a first beveled rabbet on said proximate end, said outer leaf has a second beveled rabbet on said distal end, and said middle leaf has a third beveled rabbet on said distal end and a fourth beveled rabbet on said proximate end wherein said first beveled rabbet is matingly conformed to said third beveled rabbet and said second rabbet is matingly conformed to said fourth beveled rabbet.

9. The multi leaf extendable gear hinge of claim 8 wherein said middle leaf has four threaded horizontal orifices formed therein to threadingly engage set screws that frictionally engage said first upper stub shaft, said first lower stub shaft, said second upper stub shaft and said second lower stub shaft so as to prevent rotational movement of said stub shafts.

10. The multi leaf extendable gear hinge of claim 9 further comprising a cam plate rigidly affixed to said first upper stub shaft and said first lower stub shaft.

11. The multi leaf extendable gear hinge of claim 10 further comprising a cam bearing shaft with a vertical bore therethrough, vertically mounted in said hinge housing by a second bolt passing through a third orifice formed in said top plate and a fourth orifice in said bottom plate.

* * * * *